US005948363A

United States Patent [19]

Gaillard

[11] Patent Number: 5,948,363

[45] Date of Patent: Sep. 7, 1999

[54] MICRO-WELL STRIP WITH PRINT TABS

[76] Inventor: Patrick Gaillard, P. O. Box 96, 2 Bay Ave., Oyster Bay, N.Y. 11771

[21] Appl. No.: 08/636,060

[22] Filed: Apr. 22, 1996

[51] Int. Cl.[6] ..... B01L 3/00

[52] U.S. Cl. ..... 422/102; 422/104; 435/288.4; 435/305.2

[58] Field of Search ..... 422/102, 104, 422/119; 435/288.4, 305.2

[56] References Cited

U.S. PATENT DOCUMENTS 3,190,731 6/1965 Weiskopf .
4,263,256 4/1981 Morle .
4,472,357 9/1984 Levy et al. .
4,895,706 1/1990 Root et al. .
4,948,564 8/1990 Root et al. .
5,017,342 5/1991 Haberzettl et al. .
5,084,246 1/1992 Lyman et al. .
5,096,672 3/1992 Tervamaki et al. .

*Primary Examiner*—Lyle A. Alexander
*Attorney, Agent, or Firm*—Galgano & Burke

[57] ABSTRACT

A micro-well test unit and a micro-well strip which comprises a plurality of wells arranged along an axis and print tabs provided for use in marking individual wells with desired indicia. One embodiment comprises the use of different tabs in a single micro-well strip or in a single micro-well test unit.

32 Claims, 6 Drawing Sheets

MICRO-WELL STRIP WITH PRINT TABS

The present invention relates generally to micro-well strips. More particularly, this invention relates to micro-well test units and micro-well strips having wells with print tabs for readily labeling the wells with various information related thereto.

BACKGROUND OF INVENTION

A micro-well strip generally comprises a plurality of small cylindrically-shaped closed bottom containers or wells which are either fixedly or separably connected to each other to form an axial strip. A micro-well strip usually includes either eight (8) or twelve (12) separate wells. The wells are typically used for holding a variety of test media for use in diagnostic test procedures such as blood screening, disease testing, drug testing, veterinary and agricultural testing, and many other assays.

A micro-well test unit generally comprises a frame for holding eight (8) or twelve (12) micro-well strips having a total of ninety-six (96) wells in which to conduct various tests. Micro-well strips typically include an outwardly extending axially aligned flange on each of the two terminal wells of the micro-well strip for supporting the micro-well strip on the edges of a frame so that they are readily insertable and removable from the frame and also for labeling that strip.

Micro-well strips are typically fabricated by one manufacturer and then shipped to another manufacturer for coating the inside bottom of the wells with a testing material such as a reagent. Ultimately, the treated micro-well strips are then used by a laboratory which conducts various test procedures in the coated wells.

A drawback with such micro-well strips is the inability to readily label the individual wells with desired information during or immediately prior to testing. Though, some previously disclosed frames have included numbers for example, the numbers "1" through "12" for identifying each column of the frame, and have included letters indicated along one of the side edges, for example the letters "A" through "H" for identifying each row of the frame, they have not provided adequate space for customized printing.

Another example, shown in FIG. 1, illustrates a micro-well test unit 10 manufactured by Corning. As shown in FIG. 1, test unit 10 comprises a frame 11 and two micro-well strips 12. Micro-well strip 12 comprises a plurality of wells 16 with an outwardly extending small triangular tab 18. Molded onto each triangular tab 18 is a number. Since the micro-well strips 12 are configured to provide ninety-six (96) wells in frame 11, number 19 is barely observable and does not leave space for the addition of other indicia on triangular tab 18.

A major drawback with previously disclosed micro-well strips and frames is the inability to readily label tabs of each separate well with information specifically related thereto so that the micro-well strip can be readily removed from the frame and the individual wells can be separated with out losing such information. Therefore, it would be desirable to provide a micro-well strip with print tabs on the wells so that the wells can be readily labeled with desired indicia.

SUMMARY OF THE INVENTION

One embodiment of the present invention is directed to a micro-well strip with print tabs on a plurality of non-terminal wells for use in readily labeling individual wells with desired indicia, such as the test material contained therein, the results of a test preformed therein, or an indication of the subject's identity, etc.

Another embodiment of the present invention comprises a micro-well strip with at least two discrete print tabs on at least one of the wells for use in readily labeling individual wells with a plurality of indicia.

One embodiment of the present invention advantageously provides a micro-well strip with at least one print tab on each of the wells thereby allowing the removal of the micro-well strip from a frame while retaining corresponding information related to the individual wells.

Another embodiment of the present invention comprises a micro-well strip with print tabs and wells which are separable from one another while the print tabs remain on the wells.

Various embodiments of the present invention desirably provide micro-well strips with print tabs which may be manufactured relatively simply and inexpensively.

A further embodiment of the present invention is directed toward a micro-well test unit which comprises at least one micro-well strip with print tabs for use in readily labeling individual wells with information related to the wells.

DETAILED DESCRIPTION

Figure 1:
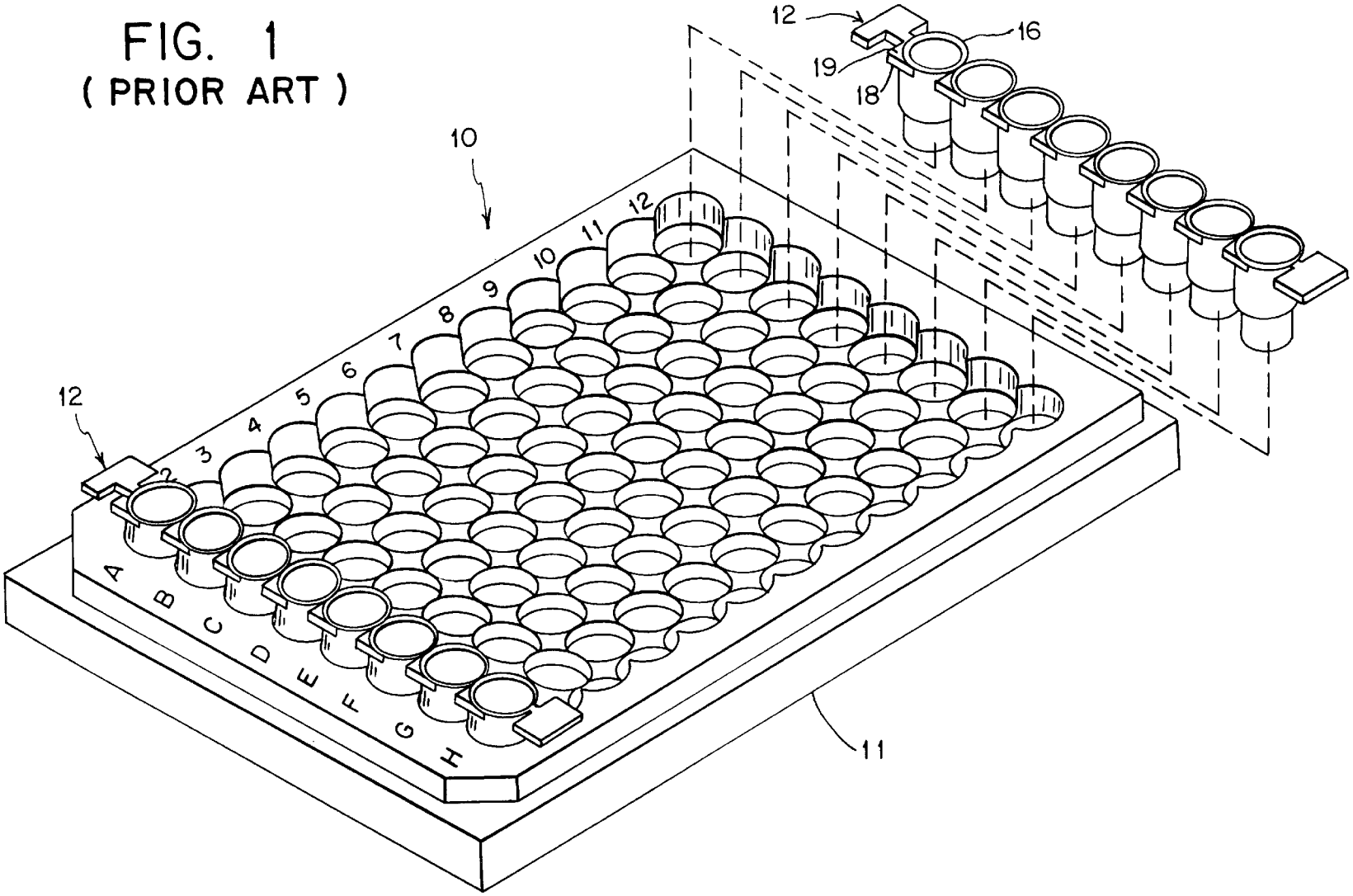
FIG. 1 ( PRIOR ART )
FIG. 1 is an exploded perspective view of a prior art micro-well test unit.
Figure 2:
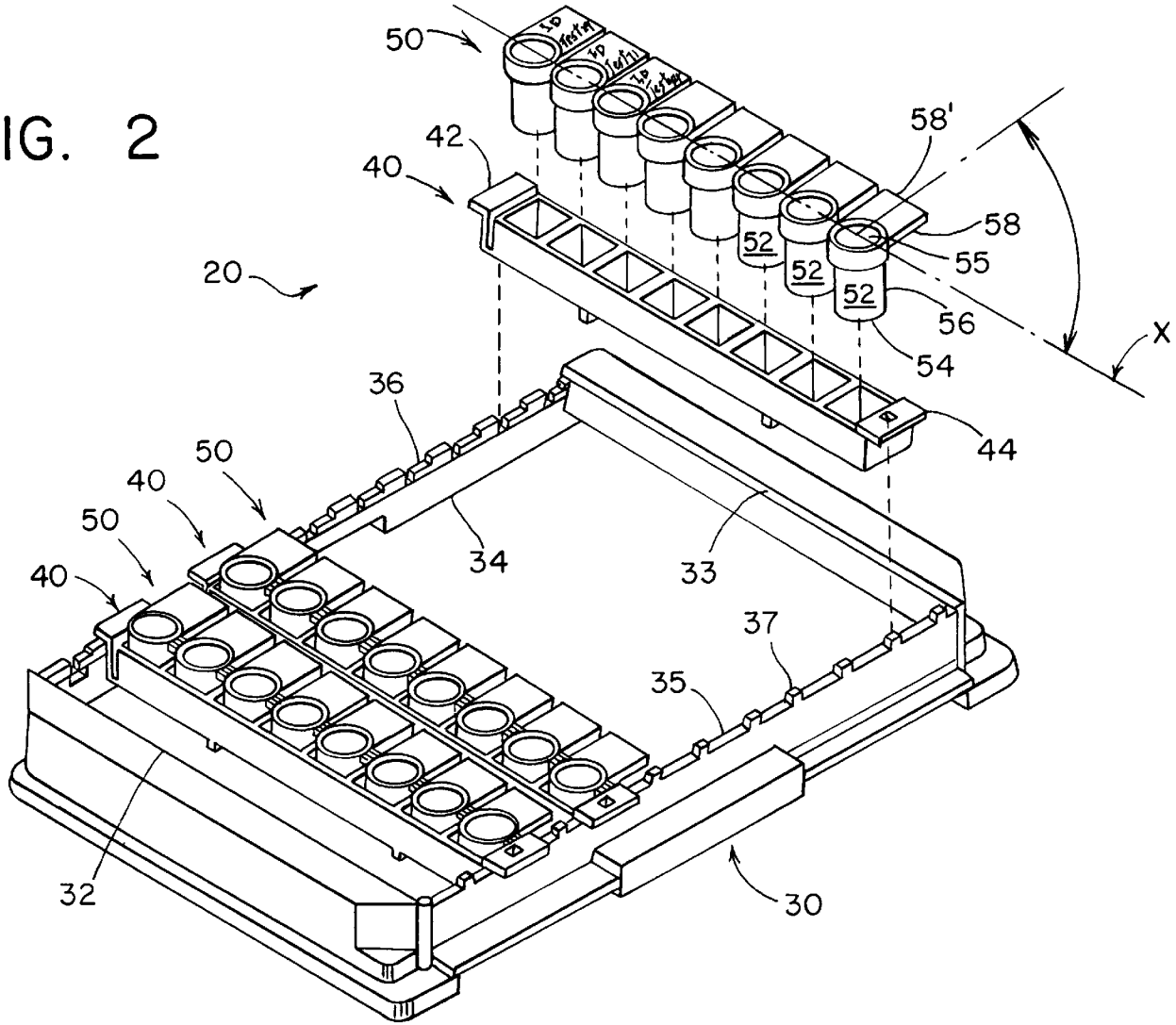
FIG. 2 is an exploded perspective view of a micro-well test unit of one embodiment of the present invention.

Turning now to the drawings, and in particular to FIG. 2, therein illustrated is a micro-well test unit 20 which comprises a frame 30, three micro-well supports 40, and three micro-well strips 50. Micro-well strips 50 are readily insertable and removable from micro-well supports 40 which are readily insertable and removable from frame 30. Micro-well strips 50 comprise a plurality of wells 52 with print tabs 58 on each well 52. As used herein, the term "print tabs" indicates a tab having a surface which can receive and retain print from a printing device sufficient to identify, e.g., the patient, the test performed in the micro-well or other desired indicia such as described below. The print tabs of the present invention thereby permit the customizing of the indica on each tab by the test kit manufacturer and/or final user as opposed to the well manufacturer. The print tabs are distinguishable from previously disclosed tabs which had been molded or engraved by the micro-well manufacturer.

Figure 3:
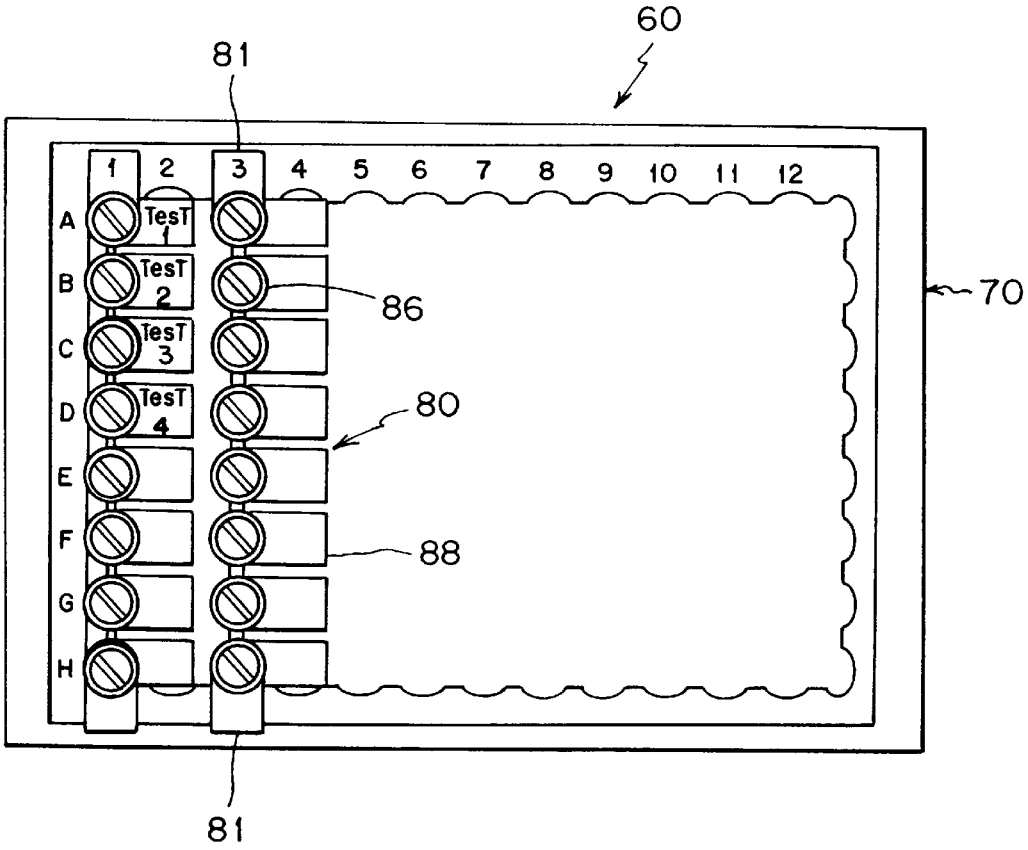
FIG. 3 is a top view of an alternative embodiment of the present invention for a micro-well test unit.
Figure 15:
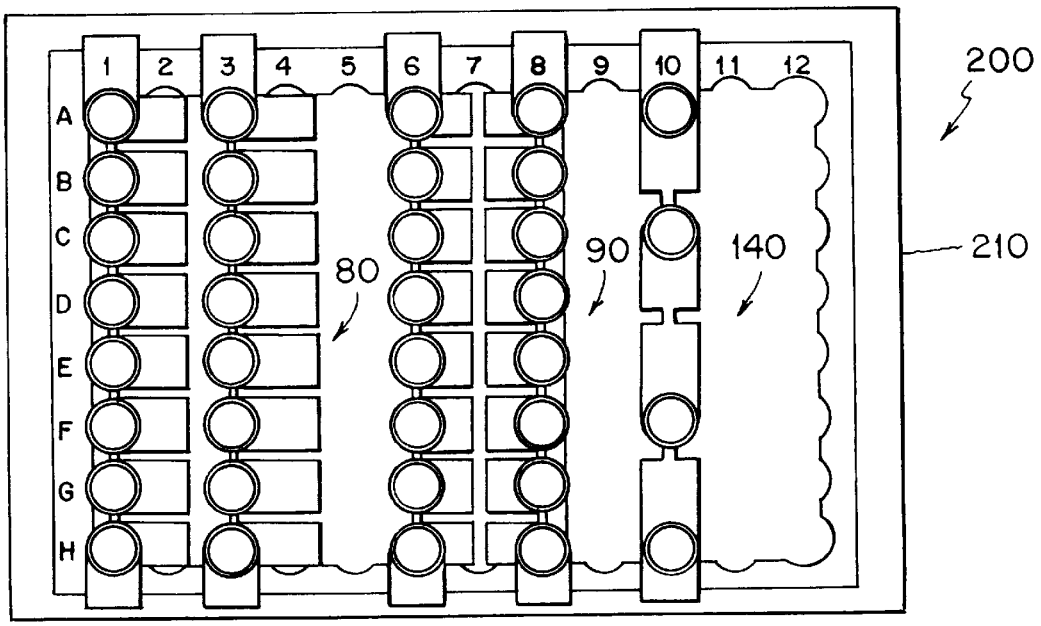
FIG. 15 is a top view of an alternative embodiment of a micro-well test unit embodying the present invention.

Furthermore, in the embodiment of FIGS. 2, 3 and 15 micro-well strips of the present invention are configured contrary to conventional wisdom in the industry. Specifically, it has been the accepted practice in the trade to included micro-well strips sized and configured so as to provide exactly ninety-six (96) wells in a frame. More specifically, the illustrated micro-well strips comprise print tabs which, when placed in a frame, extend into an adjacent strip space. These embodiments purposely give proper identification a higher priority than maximizing the number of wells in a frame, but still permit use of a conventional frame.

Print tabs 58 readily allow the labeling of individual wells 52 with desired indicia, such as the type of assay, an indication of the subject's identity for which the test was performed, operator identification, test date, test material contained therein, the results of a test preformed therein, etc. As shown in FIG. 2, some of print tabs 58 have been labeled with indicia.

The illustrated frame 30 generally comprises four vertical sides 32, 33, 34, 35 which form a rectangular frame having a central opening. Sides 34 and 35 include a plurality of spaced apart raised elements 36 and 37, respectively, for aligning various micro-well supports 40 in frame 30. The present invention is not limited to the illustrated frame. A frame could have any suitable configuration that supports the micro-wells, e.g., a C-shaped frame member or a solid frame member.

Micro-well support 40 comprises a plurality of openings for receiving the micro-wells of strip 50. Each end of micro-well support 40 also includes an outwardly extending axially aligned terminal flange 42 and 44 for supporting micro-well support 40 on sides 34 and 35 of frame 30 so that they are readily insertable and removable therefrom.

Micro-well strip 50 generally comprises a plurality of wells 52 arranged along an axis X. Wells 52 comprises a bottom 54 and an sidewall 56. Although bottom 54 is illustrated as being flat, a bottom can be configured with any desired configuration, e.g., curved or rounded. An upper edge 55 of sidewall 56 defines an opening. As shown in FIG. 2, sidewall 56 is shown cylindrically-shaped and the opening is shown as being circular. However, from the present description, it will be appreciated that a sidewall can be configured with any desired configuration, e.g., a sidewall comprising planar members so as to define an opening as being square or rectangular. In addition, the sidewalls can be disposed at any suitable angle, e.g., vertically as shown or disposed at an angle. Further, the row of wells could form a straight line or could form a slightly curved configuration.

According to this embodiment, a single print tab 58 is provided with each well 52 and is disposed substantially horizontally and to one side of axis X. Preferably, print tab 58 is perpendicular to axis X and is connected to sidewall 56 proximate the opening. The illustrated print tabs 58 comprise a distal edge 58' spaced from the nearest sidewall 56 by preferably a distance of at least one quarter the span of the opening, where the span is de fined as the length of the shortest straight line through the center of a well terminating on the walls defining the opening. As described above, frame 30 comprises a plurality of adjacent strip spaces for receiving micro-well strip 50 so that print tab 58 extends into an adjacent strip space.

FIG. 3 illustrates an alternative embodiment of a micro-well test unit. Specifically, micro-well test unit 60 comprises a frame 70 and two micro-well strips 80 which are readily insertable and removable therefrom. Desirably, micro-well strips 80 comprise flanges 81 on opposite ends thereof for supporting micro-well strip 80 thereon. According to this illustrated embodiment, print tabs 88 extend away from sidewalls 86 a distance of at least the span of the opening.

Figure 4:
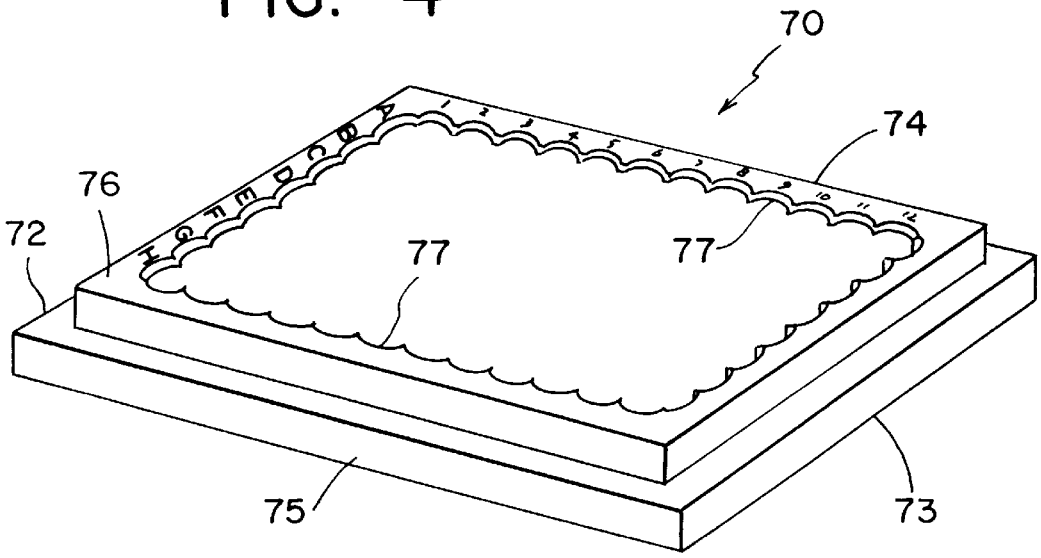
FIG. 4 is a perspective view of the frame shown in FIG. 3.

With reference to FIG. 4, frame 70 generally comprises four vertical side 72, 73, 74, 75 which form a rectangular frame having a central opening. A horizontal flange 76 extends inwardly from the upper edges of the sidewalls. As shown in FIG. 4, horizontal flange 76 contains a plurality of concave cutouts 77 for receiving the end well of the micro-well strips (not shown). Disposed along the top surface of horizontal flange 76 are alpha-numeric characters which correspond to rows and columns, respectively, of the wells (not shown).

Figure 5:
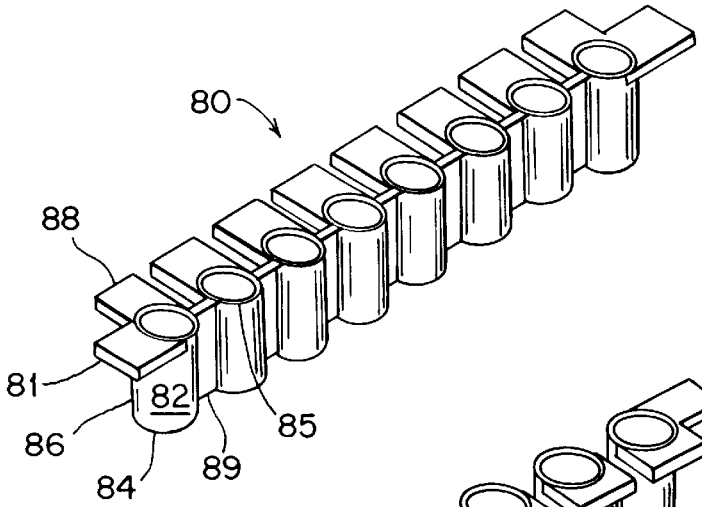
FIG. 5 is an enlarged perspective view of the micro-well strip of the present invention shown in FIG. 3.

FIG. 5 is an enlarged illustration of the micro-well strip 80 shown in FIG. 3 which generally comprises a plurality of wells 82. Well 82 comprises a bottom 84 and a sidewall 86. A single print tab 88 is provided on each well 82 and is disposed substantially horizontally and to one side of the row of wells 82. Also preferably, a flange 81 is provided on each terminal well 82.

Adjacent wells 82 of this illustrated embodiment are held together in micro-well strip 80 by a connecting member 89. Connecting member 89 extends vertically for substantially the entire length of a sidewall 86 so as to fixedly connect adjacent wells 82 together. As is described further below the connecting member can be configured to be separable, e.g. only extending a portion of the length of the sidewall or having a smaller or thinner cross-section.

Figure 6:
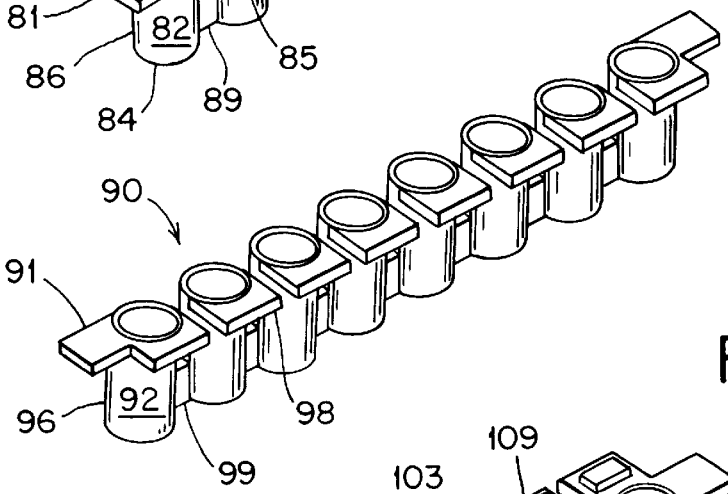
FIG. 6 is a perspective view of an alternative embodiment of a micro-well strip of the present invention.

FIG. 6 illustrates an alternative embodiment of the present invention for a micro-well strip 90 which comprises a plurality of separable wells 92. A single print tab 98 is provided on each well 92 and disposed substantially horizontally and to one side of the row of wells 92. Print tabs 98 advantageously extend a distance of about half the span of the well opening so that two micro-well strips 90 would occupy only three columns or adjacent strip spaces of a frame, as opposed to the single strip 80 shown in FIG. 5 which occupies two columns or two adjacent strip spaces.

In micro-well strip 90, adjacent wells 92 are held together by a connecting member 99. Connecting member 99 extends vertically a portion of the total length of a sidewall 96 so as to enable connecting members 99 to be separably connected. This construction holds wells 92 rigidly in place, but also allows easy separation of the wells 92.

Figure 7:
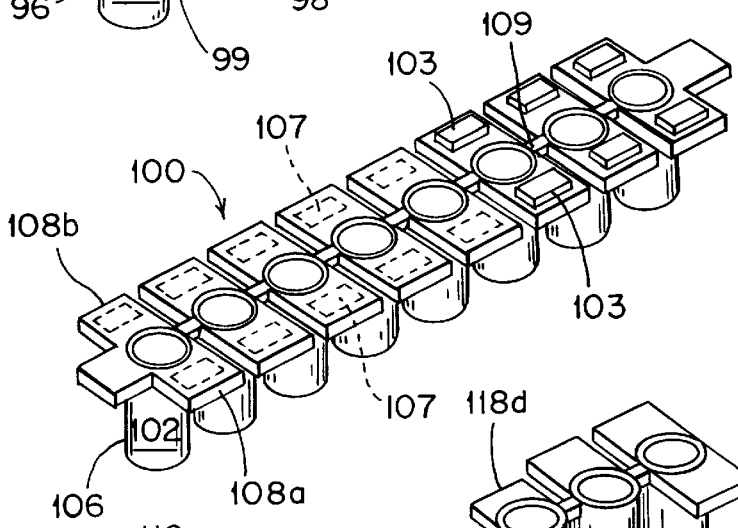
FIG. 7 is a perspective view of an alternative embodiment of a micro-well strip of the present invention.

FIG. 7 illustrates an alternative embodiment of the present invention comprising a micro-well strip 100 which generally comprises a plurality of separable wells 102. More particularly, two print tabs 108*a* and 108*b* are provided on each well 102 with print tab 108*a* being disposed on one side of the well and print tab 108*b* being disposed on the other side of the well. In this embodiment, print tabs 108*a* and 108*b* extend a distance of about the width of the row. Adjacent wells 102 are held in micro-well strip 100 by a separable connecting member 109 positioned between adjacent well openings.

Moreover, a surface portion 107 of print tabs 108*a* and 108*b* is preferably roughened so as to better retain desired indicia, e.g., ink, pencil marking, automated or manual printing, etc. From the present description it will be appreciated that surface portion 107 can include any suitable means for enhancing receipt and retention of an indicia, e.g., a white or colored marking. Further, additional indicia receiving element may be positioned on one or more of the print tabs of any of the embodiments of the present invention to enhance the receipt and retention of the indicia. For example, a self-adhesive label 103 is positioned on print tabs 108*a* and 108*b*.

Figure 8:
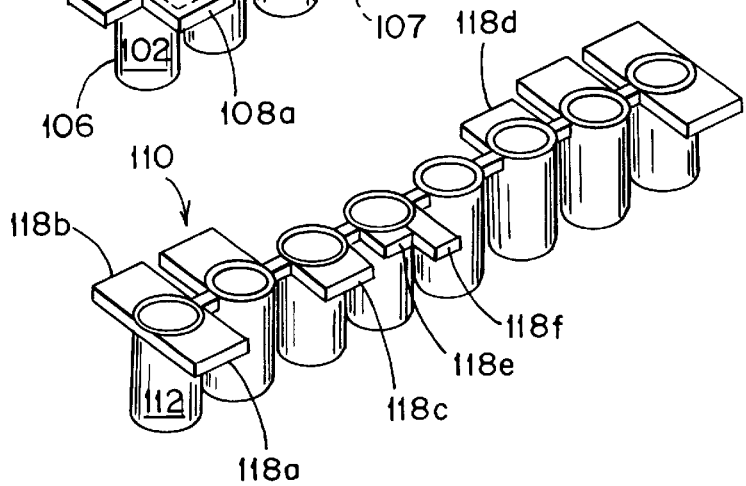
FIG. 8 is a perspective view of a further embodiment of a micro-well strip of the present invention.

FIG. 8 illustrates an alternative embodiment of the present invention comprising a micro-well strip 110 which generally comprises a plurality of separable wells 112. As shown in FIG. 8, print tabs 118*a*, 118*c*, 118*e*, 118*f* are provided on some but not all wells 112 and are disposed on one side of the row. Print tabs 118*b* and 118*d* are also provided on some but not all wells 112 and are disposed on the opposite sides of the wells. In addition, two print tabs 118*e* and 118*f* of different sizes and configurations are shown in FIG. 8 as being provided on one side of a single well 112. As illustrated in FIG. 8, print tab 118*e* extends from the sidewall of well 112 a distance of at least one quarter the span of the opening of well 112. According to this embodiment of the present invention, the use of different shapes and sizes as well as different numbers of tabs on wells can be utilized to distinguish between wells by the end user.

Figure 9:
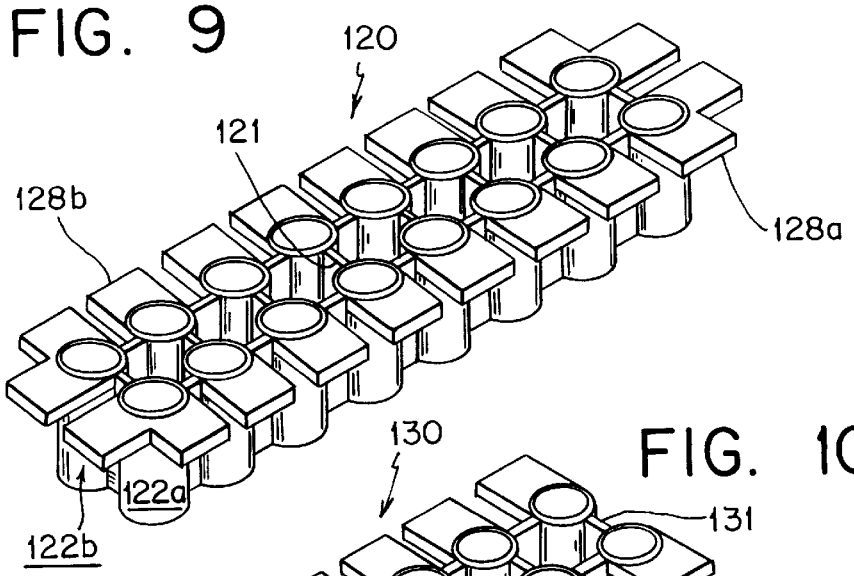
FIG. 9 is a perspective view of a still further embodiment of a micro-well strip of the present invention.
Figure 10:
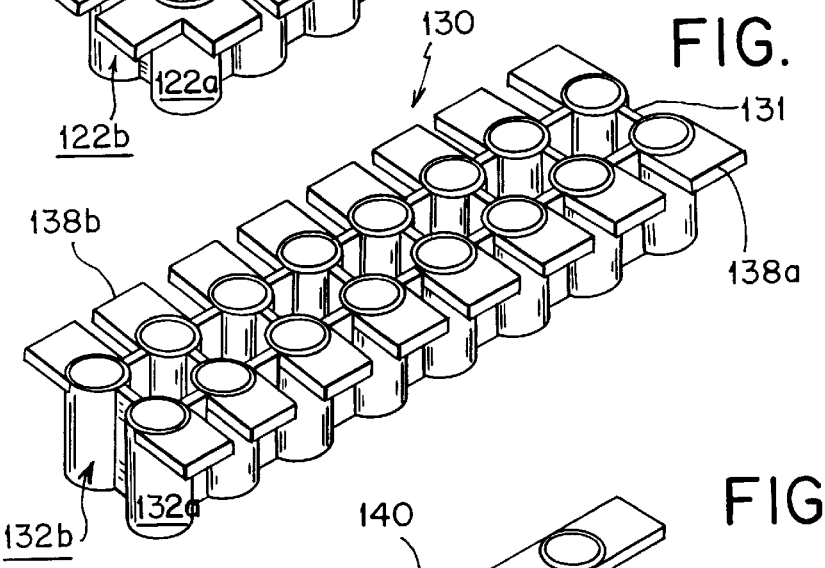
FIG. 10 is a perspective view of another embodiment of a micro-well strip of the present invention.

FIGS. 9 and 10 illustrate two further embodiments of the present invention for micro-well strips which contain double rows. As shown in FIG. 9, a micro-well strip 120 comprises a plurality of wells 122*a* and 122*b* disposed along two separate axes. Print tabs 128*a* and 128*b* are provided on wells 122*a* and 122*b*, respectively, with print tabs 128*a* disposed on one side of wells 122*a* and print tabs 128*b* disposed on the other side of wells 122*b*. Side connecting members 121 connects wells 122*a* and 122*b*. In this embodiment, the terminal edges of the print tabs are disposed about a full span from the well sidewalls. FIG. 10 illustrates a micro-well strip 130 which comprises a plurality of wells 132*a* and 132*b* disposed in two rows and having half-size print tabs 138*a* and 138*b*. Compared to FIG. 9, this embodiment does not comprise flanges extending from the ends of terminal wells 132*a* and 132*b*.

Figure 11:
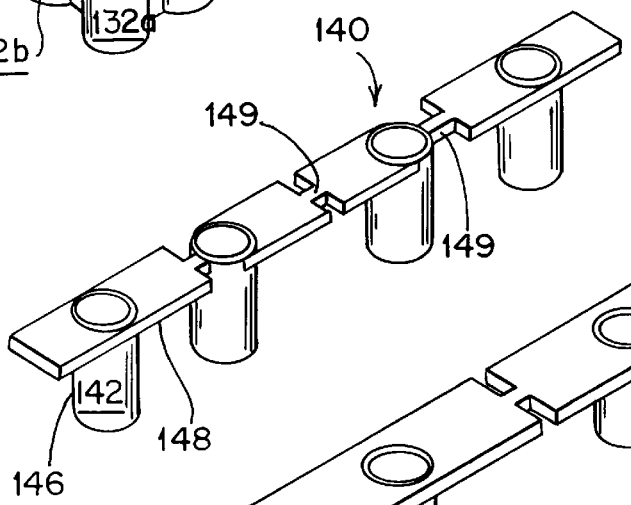
FIG. 11 is a perspective view of an alternative embodiment of a micro-well strip of the present invention.
Figure 12:
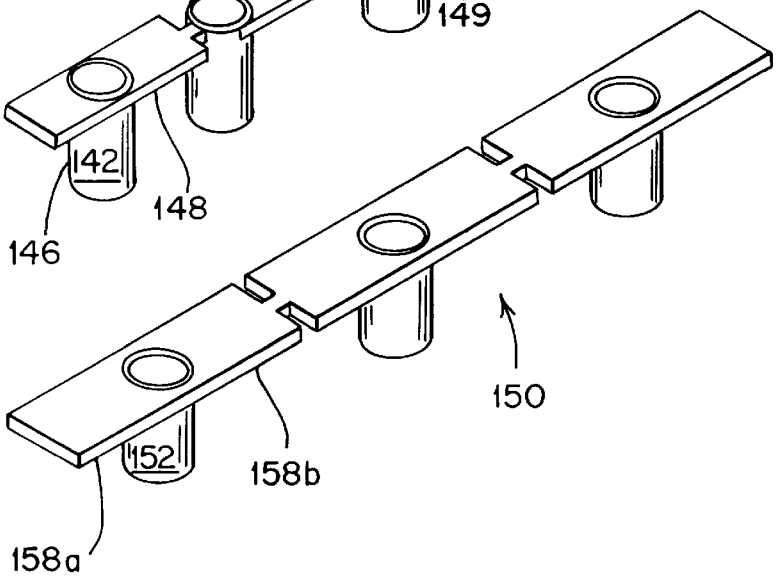
FIG. 12 is a perspective view of an alternative embodiment of a micro-well strip of the present invention.

FIGS. 11 and 12 illustrate two alternative embodiments of the present invention for micro-well strips with print tabs disposed in line with the wells. As shown in FIG. 11, micro-well strip 140 comprises a plurality of wells 142 and print tabs 148 on wells 142 disposed axially in-line with the wells 142. As shown in FIG. 11, a single print tab 148 is provided for each well 142. Connecting members 149 extend between the upper portion of sidewalls 146 and print tabs 148, and between adjacent print tabs 148 so as to enable connecting members 149 to be separable. The embodiment of FIG. 12 comprises a micro-well strip 150 which is similar to micro-well strip 140 shown in FIG. 11, except that micro-well strip 150 has two print tabs 158*a* and 158*b* provided on each well 152.

Figure 13:
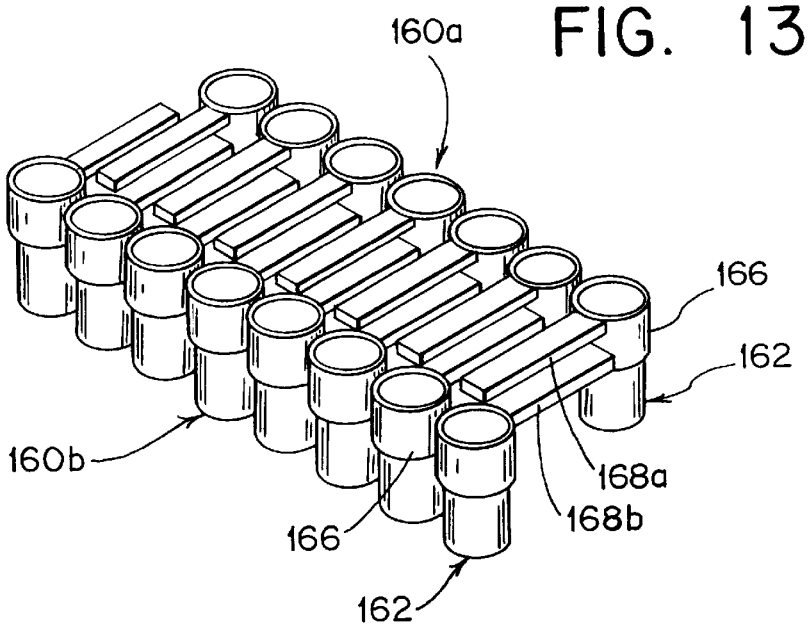
FIG. 13 is a perspective view of still another alternative embodiment of a micro-well strip of the present invention.

In the embodiment of FIG. 13 the print tabs are offset. Specifically, a micro-well strip 160*a* comprises a plurality of wells 162*a* each of which has print tab 168*a* which extends from a first portion of the well. Likewise, a micro-well strip 160*b* comprises a plurality of wells 162*b* each of which has print tab 168*b* which extends from a second portion of the well. Print tabs 168*a* and 168*b* are offset so that print tabs of adjacent wells are interweaved with tabs of opposing micro-well strips when inserted in a frame (not shown). The length of print tabs 168*a* and 168*b* is desirably equal to about the span of the well openings. From the present description, it will be appreciated the length of the tabs can be larger or smaller without departing from the scope of the present invention.

Figure 14:
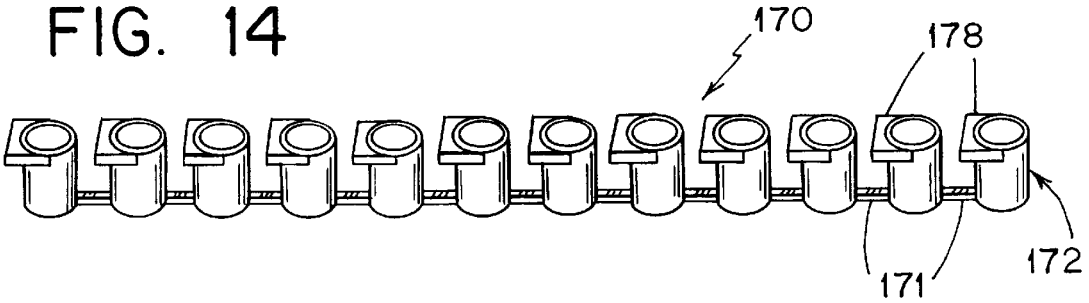
FIG. 14 is a perspective view of still yet another alternative embodiment of a micro-well strip of the present invention.

FIG. 14 illustrates a further embodiment of the present invention for a micro-well strip in which the print tabs are disposed in-line with the wells. Specifically, a micro-well strip 170 comprises a plurality of wells 172 and print tabs 178. Desirably, print tabs 178 extend outward from well 172 a distance of at least one quarter, more preferably one third, and alternatively slightly less than one-half the width or span of the row of wells. A connecting member 171 connects adjacent well 172. From the present description, it will be appreciated that the micro-well strip illustrated in FIG. 14 can be sized with wells smaller than conventionally sized wells so that even by providing print tabs, the total number of wells in a frame can total 96 or greater.

With reference now to FIG. 15, therein illustrated is another embodiment of the present invention for a micro-well test unit 200 which comprises a frame 210 and a plurality of micro-well strips. Specifically, micro-well strips comprise two micro-well strips 80, two micro-well strips 90, and one micro-well strip 140. Thus, according to this embodiment, a test unit comprises a plurality of different micro-well strips.

The micro-well strips of the present invention can be fabricated from a polymeric or other desired material. Preferably, a clear or transparent polymeric material is used when optical analysis of the contents of the wells is to be performed. The wells and tabs can advantageously be formed by any suitable process, e.g., by injection molding, as a single integral micro-well strip. In addition, the frame of a micro-well test unit is also desirably fabricated from molded material.

While the various embodiments of the present invention have been illustrated with columns of eight wells and rows of twelve columns, it is within the scope of the present invention to have strips with a different number of wells or which span a frame from side to side.

What is claimed is:

1. A micro-well strip comprising a plurality of wells arranged along an axis, each of said wells comprising:

a bottom;

a sidewall defining an opening; and at least one tab projecting from said sidewall of each of said wells in substantially the same plane as said opening for printing indicia thereon, said at least one tab disposed at an angle to said axis and comprising a distal edge spaced from said sidewall by a distance of at least of one third the span of said well opening.

2. A micro-well strip according to claim 1 wherein said at least one tab is connected to said sidewall adjacent to said opening.

3. A micro-well strip according to claim 1 wherein said at least one tab is disposed in a horizontal orientation.

4. A micro-well strip according to claim 1 wherein said at least one tab is disposed substantially perpendicular to said axis.

5. A micro-well strip according to claim 1 wherein each of said tabs is provided on a different well.

6. A micro-well strip according to claim 1 wherein at least one of said tabs is disposed to one side of said axis and at least one of said tabs is disposed on an opposite side of said axis.

7. A micro-well strip according to claim 1 wherein each of said tabs is disposed on the same side of said axis.

8. A micro-well strip according to claim 1 wherein said at least one tab extends a distance of about half said span of said well opening.

9. A micro-well strip according to claim 1 wherein said distal edge of said at least one tab is spaced from said sidewall by a distance of about said span of said well opening.

10. A micro-well strip according to claim 1 further comprising a plurality of wells arranged along a second axis.

11. A micro-well strip according to claim 1 wherein said at least one tab comprises an indicia receiving element.

12. A micro-well strip according to claim 1 wherein said tab comprises a distal edge spaced from said sidewall by a distance of at least one half the span of said well opening.

13. A micro-well strip according to claim 1 wherein each of said wells comprises two tabs.

14. A micro-well strip according to claim 13 wherein each of said wells comprises a tab disposed on one side of said axis and another tab disposed on an opposite side of said axis.

15. A micro-well strip according to claim 1 wherein adjacent wells are held together by a connecting member.

16. A micro-well strip according to claim 15 wherein said connecting member is readily separable.

17. A micro-well strip, comprising:

a plurality of wells arranged along an axis, said wells comprising a bottom, a sidewall and an opening; and at least one tab projecting from said sidewall of each of said wells in substantially the same plane as said opening for printing indicia thereon, said tab disposed along said axis and comprising a distal edge spaced from a sidewall by a distance of at least one third of the span of said well opening.

18. A micro-well strip according to claim 17 wherein said distal edge is spaced from a sidewall by at a distance of at least half said span of said well opening.

19. A micro-well strip according to claim 17 wherein said distal edge of said tab extends a distance of about said span of said well opening.

20. A micro-well strip, comprising:

a first terminal well, a second terminal well and at least one non-terminal well disposed between said first and second terminal wells and comprising a bottom and a sidewall defining an opening, said wells arranged along an axis; and at least one tab projecting from at least one of said non-terminal wells in substantially the same plane as said opening for printing indicia thereon, said at least one tab comprising a distal edge spaced from said sidewall by a distance of at least one third the span of an opening of said well.

21. A micro-well strip according to claim 20 wherein said at least one tab extends to one side of said axis.

22. A micro-well strip according to claim 20 wherein said at least one print tab extends in-line with said axis.

23. A micro-well test unit, comprising:

a frame member comprising means for supporting at least one micro-well strip, and at least one micro-well strip comprising a first terminal well, a second terminal well and at least one non-terminal well disposed between said first and second terminal wells and comprising a bottom and a sidewall defining and opening, said wells arranged along an axis; and at least one tab projecting from at least one of said non-terminal wells in substantially the same plane as said opening for printing indicia thereon, said at least one tab comprising a distal edge spaced from said sidewall by a distance of at least one third the span of an opening of said well.

24. A micro-well test unit according to claim 23 wherein said at least one tab extends to one side of said axis.

25. A micro-well test unit according to claim 23 wherein said at least one tab extends in-line with said axis.

26. A micro-well test unit according to claim 23 wherein comprising a plurality of micro-well strips wherein at least two of said strips have different configurations.

27. A micro-well test unit according to claim 23 wherein said tabs on said different strips are configured differently.

28. A micro-well test unit according to claim 23 wherein said supporting means supports a plurality of micro-well strips in adjacent strip spaces, and said tab extends into an adjacent strip space.

29. A micro-well test unit according to claim 23 wherein said tab comprises a distal edge spaced from said sidewall by a distance of at least one half the span of an opening of said well.

30. A micro-well comprising:

a bottom;

a surrounding sidewall defining an opening comprising a span which is the shortest straight distance through the center of said opening; and at least one tab projecting from said sidewall in substantially the same plane as said opening for printing indicia thereon and comprising a distal edge spaced from said sidewall by a distance of at least one third the span of said well opening.

31. A micro-well according to claim 30 wherein said distal edge of said at least one tab is spaced from said sidewall by a distance of about said the span of said.

32. A micro-well according to claim 30 wherein at least two tabs are connected to said sidewall.

* * * * *